United States Patent [19]

Inoue et al.

[11] Patent Number: 4,755,449

[45] Date of Patent: Jul. 5, 1988

[54] SILVER HALIDE PHOTOGRAPHIC MATERIAL AND METHOD FOR FORMING SUPER HIGH CONTRAST NEGATIVE IMAGES THEREWITH

[75] Inventors: Nobuaki Inoue; Senzo Sasaoka, both of Kanagawa, Japan

[73] Assignee: Fuji Photo Film Co., Ltd., Kanagawa, Japan

[21] Appl. No.: 903,806

[22] Filed: Sep. 4, 1986

[30] Foreign Application Priority Data

Sep. 4, 1985 [JP] Japan ..... 60-195657

[51] Int. Cl.[4] ..... G03C 1/06; G03C 5/24

[52] U.S. Cl. ..... 430/267; 430/264; 430/445; 430/446; 430/599; 430/564; 430/567; 430/600; 430/603

[58] Field of Search ..... 430/567, 564, 599, 264, 430/949, 267, 445, 446, 447, 600, 603

[56] References Cited

U.S. PATENT DOCUMENTS

| | | | |
|---|---|---|---|
| 4,070,190 | 1/1978 | Friedrich et al. | 430/949 |
| 4,323,643 | 4/1982 | Mitune et al. | 430/949 |
| 4,569,904 | 2/1986 | Okutsu et al. | 430/949 |

*Primary Examiner*—Won H. Louie

*Attorney, Agent, or Firm*—Sughrue, Mion, Zinn, Macpeak, and Seas

[57] ABSTRACT

A negative type silver halide photographic material and a method for processing the photographic material to form a super high contrast negative image are disclosed. The photographic material comprises a support and at least one emulsion layer on the support, said emulsion layer comprising silver halide grains comprising a core of silver halide containing silver iodide and a shell covering the core, said shell consisting essentially of silver bromide, silver chloride, or silver chlorobromide and having a thickness of from 0.01 to 0.08 μm, wherein the emulsion layer or a hydrophilic colloid layer other than the emulsion layer of the photograpic material contains a hydrazine derivative.

14 Claims, No Drawings

SILVER HALIDE PHOTOGRAPHIC MATERIAL AND METHOD FOR FORMING SUPER HIGH CONTRAST NEGATIVE IMAGES THEREWITH

FIELD OF THE INVENTION

The present invention relates to a silver halide photographic material and a method for forming super high contrast negative images using said material. More particularly, it is concerned with a silver halide photographic material for use in the photo-engraving process and a method for forming super high contrast negative images using said material.

BACKGROUND OF THE INVENTION

In the field of graphic art, a method for forming images exhibiting photographic characteristics such that the contrast is quite high (particularly a gamma value of 10 or more) is needed to ensure good reproduction of images of continuous gradation comprising dot images or good reproduction of line images.

For this method, a special developer called a "lith developer" has heretofore been used. This lith developer contains only hydroquinone as a developing agent, and is greatly decreased in the concentration of free sulfite ions (usually not more than 0.1 mol/liter) by using a sulfurous acid salt as a preservative in the form of a formaldehyde adduct so as not to deteriorate the infectious developing properties of the lith developer. Therefore, the lith developer has a serious disadvantage in that it is quite easily subjected to air oxidation; thus, it cannot be stored for more than 3 days.

To obtain good photographic characteristics such as high contrast, a method of using hydrazine derivatives is known, as described, for example, in U.S. Pat. Nos. 4,224,410, 4,168,977, 4,166,742, 4,311,781, 4,272,606, 4,211,857, 4,243,739, etc. This method permits the formation of images exhibiting photographic characteristics such as super high contrast and high sensitivity, and, furthermore, since a high concentration of a sulfurous acid salt can be added to the developer to be used, the stability of the developer against air oxidation is greatly increased as compared with the lith developer.

The above method, however, causes the undesired phenomenon, e.g., formation of black spots due to infections development although it provides high sensitivity and high contrast, and produces a serious problem in the photo-engraving process. The black spots are formed in non-exposed areas between halftone dots (sometimes called black pepper). This phenomenon becomes particularly conspicuous when the sulfite ion content in a developer is decreased or the pH of a developer increases due to fatigue of the developer which is stored for a long period of time, particularly under high temperature/high humidity condition, and it causes a significant reduction in photographic quality.

Various attempts have hitherto been made in order to eliminate the problem of black spots, but such improvements are frequently accompanied by reduction in sensitivity and gamma value. Thus, no means has been known for solving the problem of black spots without hindering the effect using the above-described hydrazine compounds to increase sensitivity and contrast.

SUMMARY OF THE INVENTION

An object of the present invention is to provide a silver halide photographic material which forms an image exhibiting photographic characteristics such that the sensitivity and contrast are high to such an extent that the gamma is in excess of 10, and that the formation of black spots is markedly reduced, even when developed with a stable developer.

The above object can be accomplished by a negative type silver halide photographic material comprising a support and at least one silver halide emulsion layer on the support, wherein said emulsion layer comprises silver halide grains comprising a core of silver halide containing silver iodide and a shell covering the core, said shell consisting essentially of silver bromide, silver chloride, or silver chlorobromide, and having a thickness of from 0.01 to 0.08 μm, and said emulsion layer or a hydrophicic colloid layer other than the emulsion layer of said photographic material contains a hydrazine derivative.

In another aspect, the invention is directed to a method for forming a super high contrast negative image which comprises imagewise exposing the above photographic material and then developing it with a developer containing at least 0.15 mol/liter of sulfite ion and having a pH of from 10.5 to 12.3.

DETAILED DESCRIPTION OF THE INVENTION

Hydazine derivatives which can be used in the present invention include hydrazine derivatives having a sulfinyl group as described in U.S. Pat. No. 4,478,928 and compounds represented by formula (I):

$$R_1\text{—NHNH—CHO} \qquad (I)$$

wherein $r_1$ is an aliphatic, aromatic, or heterocyclic group.

The aliphatic group represented by $R_1$ in formula (I) preferably has from 1 to 30 carbon atoms and is particularly preferably a straight, branched, or cyclic alkyl group having from 1 to 20 carbon atoms. This branched alkyl group may be cyclized so as to form a saturated hetero ring containing one or more hetero atoms therein. The alkyl group may be substituted with groups such as an aryl group, an alkoxy group, a sulfoxy group, a sulfonamide group, and a carbonamide group.

Typical examples include a tert-butyl group, an n-octyl group, a tert-octyl group, a cyclohexyl group, a pyrrolydyl group, an imidazolyl group, a tetrahydrofuryl group, and a morpholino group.

The aromatic or heterocyclic group represented by $R_1$ in formula (I) is preferably a monocyclic or dicyclic aryl group, or an unsaturated hetero ring group. The unsaturated hetero ring group may condense with a monocyclic or dicyclic aryl group to form a heteroaryl group.

Typical examples include a benzene ring, a naphthalene ring, a pyridine ring, a pyrimidine ring, an imidazole ring, a pyrrazole ring, a quinoline ring, an isoquionoline ring, a benzimidazole ring, a thiazole ring, and a benzothiazole ring. Of these compounds, those containing a benzene ring are preferred.

A particularly preferred example represented by $R_1$ in formula (I) is an aryl group.

The aryl group, or aromatic or heterocyclic group represented by $R_1$ may have one or more substituents.

Typical examples of substitutents include a straight, branched, or cyclic alkyl group (preferably having from 1 to 20 carbon atoms), an aralkyl group (preferably a monocyclic or dicyclic group in which the alkyl portion has from 1 to 3 carbon atoms), an alkoxy group (preferably having from 1 to 20 carbon atoms), a substituted amino group (preferably an amino group substituted with an alkyl group having from 1 to 20 carbon atoms), an acylamino group (preferably having from 2 to 30 carbon atoms), a sulfonamido group (preferably having from 1 to 30 carbon atoms), and a ureido group (preferably having from 1 to 30 carbon atoms). A particularly preferred example of substituents is an acylamino group or a ureido group.

In $R_1$ of formula (I) may be incorporated a ballast group which is commonly used in immobile photographic additives such as couplers. The ballast group is a group having at least 8 carbon atoms and is relatively inert to photographic properties. The ballast group can be chosen from an alkyl group, an alkoxy group, a phenyl group, an alkylphenyl group, a phenoxy group, an alkylphenoxy group, and the like.

In $R_1$ of formula (I) may be incorporated a group capable of increasing adsorption onto the silver halide particle surface. Such adsorption groups includes a thiourea group, a heterocyclic thioamide group, a mercapto heterocyclic group, a triazole group, and the like as described in U.S. Pat. No. 4,385,108.

Methods of synthesizing these compounds are described, for example, in U.S. Pat. Nos. 4,168,977, 4,224,401, 4,171,977, and 4,323,643.

In the present invention, when the hydrazine derivatives are incorporated in the photographic lightsensitive material, it is preferred that the hydrazine derivatives be incorporated in a silver halide emulsion layer. The hydrazine derivatives may be incorporated in a light-insensitive hydrophilic colloid layers (e.g., a protective layer, an interlayer, a filter layer, and an anti-halation layer) other than the silver halide emulsion layer. When the hydrazine derivatives are water-soluble, it is added to a hydrophilic colloid solution in the form of an aqueous solution, and when sparingly soluble in water, it is added to a hydrophilic colloid solution in the form of a solution using an organic solvent miscible with water, such as alcohols, esters, and ketones. When the hydrazine derivatives are added to a silver halide emulsion layer, it may be added at any desired stage from the start of chemical ripening to coating, but it is preferably added during the period from the finish of the chemical ripening to the coating. It is particularly preferred that the hydrazine derivatives be added to a coating solution prepared for coating.

The optimum amount of the hydrazine derivatives to be added can be easily determined by one skilled in the art although it varies with factors such as the grain size, the halogen composition, and method and extent of chemical sensitization of a silver halide emulsion, the relation between a layer in which the hydrazine derivatives are to be incorporated and the silver halide emulsion layer, the type of anti-foggant, and so forth. Usually, the compound is used preferably in an amount of from $1\times10^{-6}$ to $1\times10^{-1}$ mol per mol of silver halide, and particularly preferably in an amount of from $1\times10^{-5}$ to $4\times10^{-2}$ mol per mol of silver halide.

Representative examples of the compounds represented by formula (I) are shown below, although the present invention is not limited thereto.

I-1

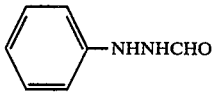

I-2

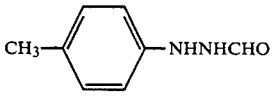

I-3

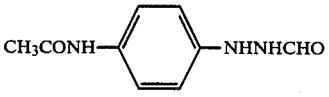

I-4

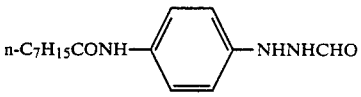

I-5

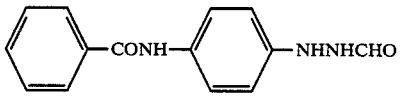

I-6

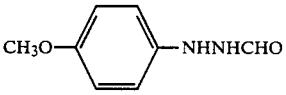

I-7

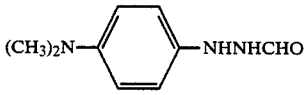

I-8

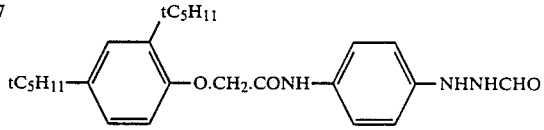

I-9

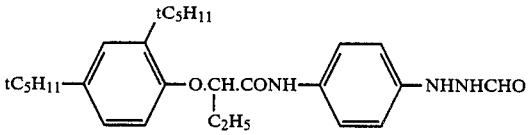

I-10

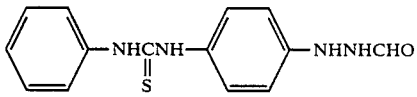

I-11

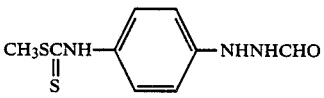

I-12

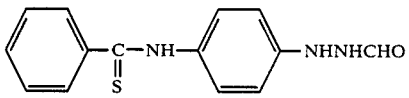

I-13

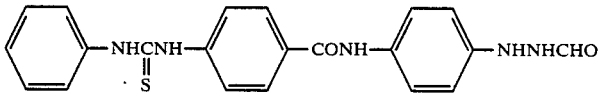

-continued
I-14
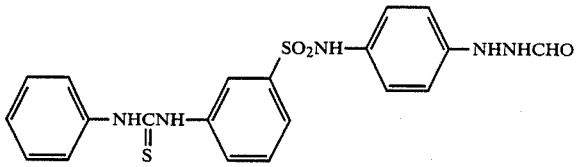
I-15
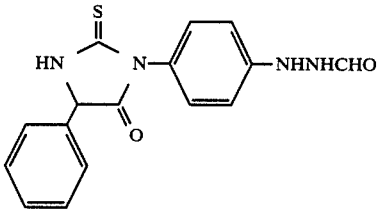
I-16
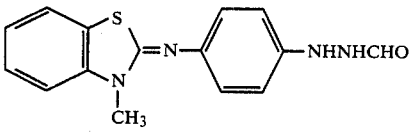
I-17
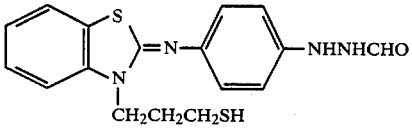
I-18
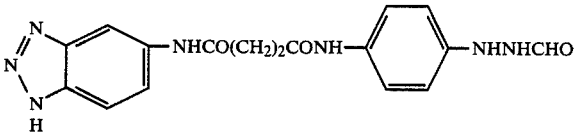
I-19
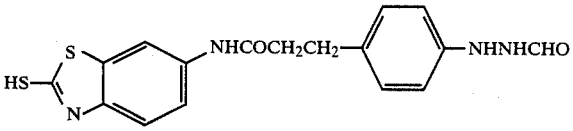
I-20
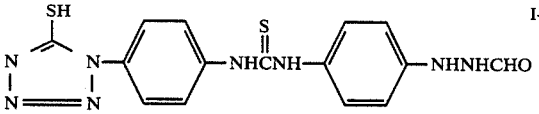
I-21
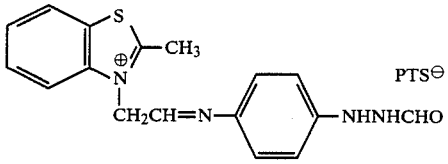
I-22
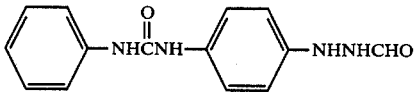
I-23
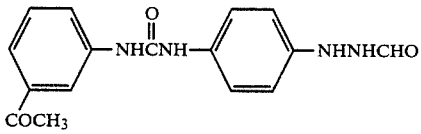
I-24
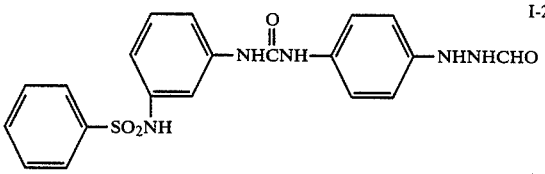
I-25
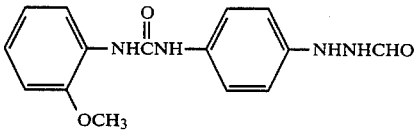
I-26
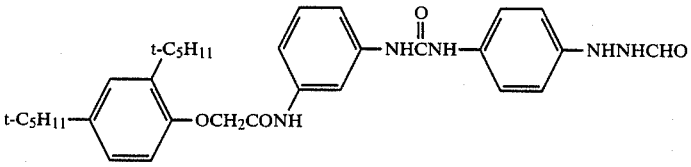

-continued

I-27

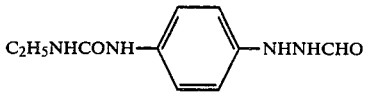

I-28

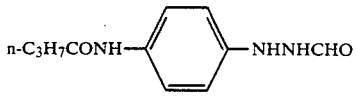

I-29

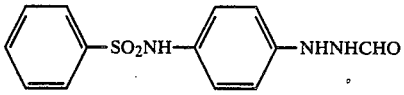

I-30

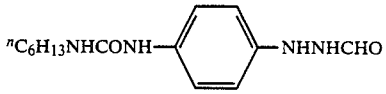

I-31

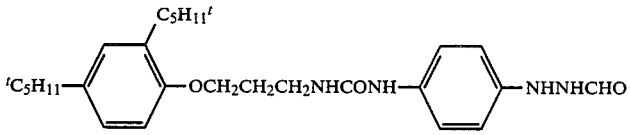

I-32

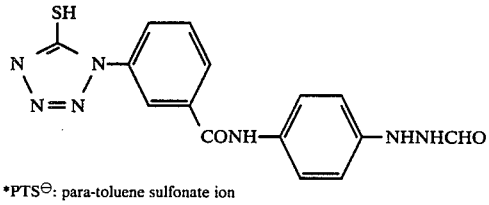

I-33

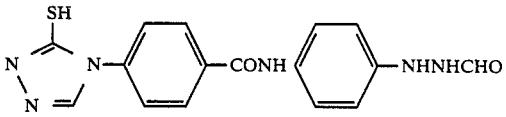

*PTS$^{\ominus}$: para-toluene sulfonate ion

Further, compounds represented by the following formulae as described in U.S. Pat. No. 4,478,928 can also be used.

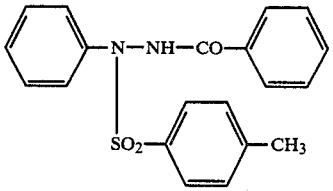

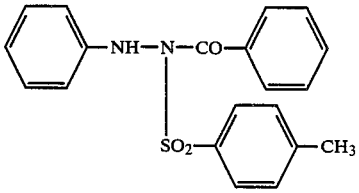

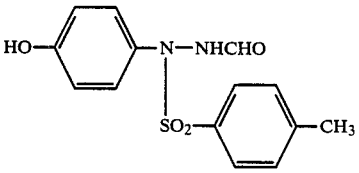

Silver halide which is used in the present invention comprises a core of silver halide containing silver iodide and a shell consisting essentially of silver bromide, silver chloride, or silver chlorobromide. The silver iodide content of the core is preferably from 1.0 to 8 mol %, and more preferably from 1.5 to 4 mol %, and iodide is preferably distributed uniformly in the core. The particle size of the core is preferably from 0.15 to 0.4 μm, and more preferably from 0.2 to 0.35 μm. The shell preferably consists of silver bromide, and the thickness of the shell is preferably from 0.01 to 0.08 μm and more preferably from 0.02 to 0.06 μm. Silver iodide in silver halide has an advantage of high sensitization, but in the hydrazine infectious developing system, it has a disadvantage in that it often more causes the formation of black spots with an increase of gamma. Accordingly, a feature of the present invention resides in that to make silver iodide exhibit its preferred effect and to reduce the undesirable phenomenon, a shell controlled in thickness to a specific range is provided covering the surface of the core. The thickness of the shell covering the core is such that it does not reduce the preferred characteristics of core iodide, and at the same time, is sufficient to reduce the undesirable characteristics of core iodide. If the thickness of the shell is less than the specified range of the present invention, the formation of black spots is more increased. On the other hand, if the thickness of the shell is in excess of the range of the present invention. the sensitivity and gamma are reduced.

The shell of silver halide which is used in the present invention does not substantially contain silver iodide.

The expressions "consisting essentially of" and "not substantially containing" as used herein means that not more than 0.4 mol % of the silver halide constituting the shell is silver iodide. If the silver iodide content is not more than 0.4 mol %, silver iodide had better be present, on the surface of the shell.

The average grain size of silver halide used in the present invention is preferably not more than 0.7 μm, and particularly preferably not more than 0.4 μm. Although there are no limitations to the grain size distribution, it is preferred to use monodisperse silver halide grain. The term "momodisperse silver halide grain" as used herein means that at least 95% of the silver halide grains as determined based on either weight or a number of grains, have a grain size falling within the range of the average grain size ±40%.

Silver halide particles which are used in the present invention are preferably particles having a regular form crystal, such as a cubic, a tetradecahedral or an octahedral form.

A silver halide emulsion containing silver halide particles having a shell the wall thickness of which falls within the range of the present invention can be prepared by covering silver halide particles contained in a monodispersion emulsion as the core with a shell. For example, in the case of silver halide particles comprising a core of monodispersion silver iodobromide and a shell of silver bromide, an aqueous silver nitrate solution and an aqueous potassium iodide/potassium bromide solution are added at the same time to a gelatin solution maintained at a constant temperature in the presence of ammonia while maintaining the aqueous potassium iodide/potassium bromide solution at a constant pAg to form a core of silver iodobromide, neutralizing the core with acetic acid and adding an aqueous silver nitrate solution and an aqueous potassium bromide solution at a constant pAg to thereby provide the core with a shell of silver bromide.

The emulsion of the present invention may be prepared by mixing two or more silver halide emulsions. In this case, it is preferred that the core/shell emulsion of the present invention be not less than 60 mol %, with the range of not less than 80 mol % being particularly preferred.

In the formation of silver halide grains or the process of the physical ripening thereof, a cadmium salt, a sulfurous acid salt, a lead salt, a thallium salt, a rhodium salt, or a complex salt thereof, an iridium salt or a complex salt thereof, etc. may be present in the silver halide emulsion as described in G. F. Duffin, *Photographic Emulsion Chemistry,* The Focal Press, (1966).

A silver halide emulsion that is particularly preferable for the present invention is prepared in the presence of an iridium salt or a complex salt thereof in an amount of from $1\times10^{-8}$ to $1\times10^{-5}$ mol per mol of silver and has a larger silver iodide content in the surface of each grain than the average throughout the whole of each individual grain. Use of an emulsion containing such a silver haloiodide results in higher sensitivity and increased gamma.

The iridium salt of the above-specified amount is desirably added to the silver halide emulsion before the completion of physical ripening, particularly during the grain formation.

Iridium salts which can be used in the present invention include water-soluble iridium salts or iridium complex salts, such as iridium trichloride, iridium tetrachloride, potassium hexachloroiridate (III), potassium hexachloroiridate (IV), ammonium hexachloroiridate (III), etc.

Binders or protective colloids for photographic emulsions include gelatin to advantage, but other hydrophilic colloids may also be employed. Examples of useful hydrophilic colloids include proteins, such as gelatin derivatives, graft polymers of gelatin with other polymers, albumin, casein, etc.; cellulose derivatives, such as hydroxyethyl cellulose, carboxymethyl cellulose, cellulose sulfate, etc.; sugar derivatives, such as sodium alginate, starch derivatives, etc.; and a large variety of synthetic hydrophilic polymers, such as homopolymers, e.g., polyvinvyl alcohol, polyvinyl alcohol partial acetal, poly-N-vinylpyrrolidone, polyacrylic acid, polymethacrylic acid, polyacrylamide, polyvinylimidazole, polyvinylpyrazole, etc., and copolymers comprising monomers constituting these homopolymers.

The silver halide emulsion which is used in the present invention may (or may not) be subjected to chemical sensitization. Chemical sensitization can be carried out by sulfur sensitization, reduction sensitization, noble metal sensitization, or a combination thereof. These methods are described in H. Frieser ed., *Die Grundlagen der Photographisischen Prozesse mit Silberhalogeniden,* Adamedische Verlagsgesellschaft (1968).

Gold sensitization, which is a typical example of noble metal sensitization, employs a gold compound, mainly a complex salt thereof. Complex salts of noble metals other than gold, such as platinum, palladium, iridium, etc., can be incorporated, Specific examples thereof are described in U.S. Pat. No. 2,448,060, British Pat. No. 618,061, and so on.

Sulfur sensitizing agents which can be used include as well as sulfur compounds contained in gelatin, various sulfur compounds such as thiosulfates, thioureas, thiazoles, rhodanines, etc.

Reduction sensitizing agents which can be used include stannous salts, amines, foramidinesulfinic acid, silane compounds, etc.

For the purpose of increasing sensitivity, the photographic light-sensitive materials of the present invention can contain sensitizing dyes, such as cyanine dyes, merocyanine dyes, etc., as described, for example, in U.S. Pat. No. 4,243,739.

These sensitizing dyes may be used either alone or in combination with each other. Combinations of sensitizing dyes are often used particularly for the purpose of supersensitization. The photographic emulsions may contain, in addition to the sensitizing dyes, a dye which has per se no spectrally sensitizing effect or a substance which does not substantially absorb visible light, but said dye or substance exhibiting supersensitizing effect.

Specific examples of useful sensitizing dyes, combinations of dyes for supersensitization, and substances exhibiting supersensitizing effect are disclosed, for example, in *Research Disclosure,* Vol. 176, RD No. 17643, page 23, (Dec., 1979), IV-J.

The photographic light-sensitive materials according to the present invention can contain various compounds known as antifoggants or stabilizers for the purpose of preventing fog during preparation, preservation, or photographic processing of the photographic materials, or for stabilizing photographic performances. Examples of such compounds include azoles, e.g., benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles, etc.; mercaptopyrimidines; mercaptotriazines; thioketo compounds, e.g., oxazolinethione, etc.; azaindenes, e.g., triazaindenes, tetraazaindenes (especially 4-hydroxy-substituted (1,3,3a,7)tetraazaindenes), pentaazaindenes, etc,; benzenethiosulfonic acid; benzenesulfinic acid; benzenesulfonic acid amide; and the like. Preferred among them are benzotriazoles, e.g., 5-methylbenzotriazole and nitroindazoles, e.g., 5-nitroindazole. These compounds may also be incorporated in a processing solution.

The photographic emulsion layers or a hydrophilic colloid layer other than the emulsion layer of the photographic light-sensitive materials of the present invention may contain an organic or inorganic hardener, such as a chromium salt, e.g., chrominum alum, chromium acetate, etc.; an aldehyde, e.g., formaldehyde, glyoxal, glutaraldehyde, etc.; an N-methylol compound, e.g., dimethylolurea, methyloldimethylhydantoin, etc.; dioxane derivatives, e.g., 2,3-dihydroxydioxane, etc.; an active vinyl compound, e.g., 1,3,5-triacryloyl-hexahydro-s-triazine, 1,3-vinylsulfonyl-2-propanol, etc.; and active halogen compound, e.g., 2,4-dichloro-6-hydroxy-s-triazine, etc.; a mucohalogenic acid, e.g., mucochloric acid, mucophenoxychloric acid, etc.; and the like, either alone or in combinations thereof.

The photographic emulsion layers or the hydrophilic colloid layer other than the emulsion layer of the photographic light-sensitive materials of the present invention may further contain a large variety of surface active agents for various purposes, for example, as coating aids, as antistatic agents, for improvement of sliding properties, as emulsification or dispersion, for prevention of adhesion, for improvement of photographic characteristics (e.g., development acceleration, increasing contrast, increasing sensitivity, etc.), and the like.

Examples of the surface active agents to be used in the present invention include nonionic surface active agents such as saponin (steriod type), alkylene oxide derivatives, e.g, polyethylene glycol, polyethylene glycol/polypropylene glycol condensates, polyethylene glycol alkyl ethers or polyethylene glycol alkyl aryl ethers, polyethylene glycol esters, polyethylene glycol sorbitan esters, polyalkylene glycol alkylamines or amides, polyethylene oxide adducts of silicone, etc., glycidol derivatives, e.g., alkenylsuccinic polyglycerides, alkylphenyl polyglycerides, etc., fatty acid esters of polyhydric alcohols, alkyl esters of sugars, and the like; anionic surface active agents containing acidic groups, e.g., a carboxyl group, a sulfo group, a phospho group, a sulfuric ester group, a phosphoric ester group, etc., such as alkylcarboxylates, alkylsulfonates, alkylbenzenesulfonates, alkylnaphthalenesulfonates, alkylsulfates, alkylphosphates, N-acyl-N-alkyltaurins, sulfosuccinates, sulfoalkylpolyoxyethylene alkylphenyl ethers, polyoxyethylene alkylphosphates, and the like; amphoteric surface active agents, such as amino acids, aminoalkylsulfonic acids, aminoalkyl sulfates or phosphates, alkylbetaines, amine oxides, and the like; and cationic surface active agents, such as alkylamine salts, aliphatic or aromatic quaternary ammonium salts, heterocyclic quaternary ammonium salts, e.g., pyridinium, imidazolium, etc., aliphatic or heterocyclic phosphonium or sulfonium salts, and the like.

Of these compounds, polyalkylene oxides having a molecular weight of 600 or more, as described in U.S. Pat. No. 4,221,857, are preferably used in the present invention.

The photographic emulsion layer or hydrophilic colloid layer other than the emulsion layer of the photographic light-sensitive material of the present invention may contain a matting agent such as silica, magnesium oxide, and polymethyl methacrylate for the purpose of preventing adhesion.

The light-sensitive material of the present invention may contain a dispersion of a water-soluble or sparingly soluble synthetic polymer for the purpose of improving its dimensional stability. For example, homo- and copolymers of monomers such as alkyl acrylate or alkyl methacrylate, alkoxyalkyl acrylate or alkoxyalkyl methacrylate, glycidyl acrylate or glycidyl methacrylate, acrylamide or methacrylamide, vinyl esters (e.g., vinyl acetate), acrylonitrile, olefin and styrene; and copolymers of the above monomers and comonomer such as acrylic acid, methacrylic acid, $\alpha,\beta$-unsaturated dicarboxylic acid, hydroxy alkyl acrylate or hydroxy alkyl methacrylate, sulfoalkyl acrylate or sulfoalkyl methacrylate, and styrenesulfonic acid can be used.

In obtaining photographic characteristics of super high contrast and high sensitivity using the silver halide light-sensitive material of the present invention, it is not necessary to use the conventional infectious developers or high alkali developers having a pH of about 13 as described in U.S. Pat. No. 2,419,975; and a stable developer can be used.

That is, the silver halide photographic material of the present invention can provide negative images of sufficiently high contrast having a gamma ($\gamma$) of more than 10 when developed with a developer containing at least 0.15 mol/liter (developer), and preferably from 0.2 to 0.8 mol/liter (developer) of sulfite ion and having a pH of from 10.5 to 12.3, particularly from 11.0 to 12.0.

The developing agent for use in the developer which can be used in the present invention is not critical. Dihydroxybenzenes are preferred in that good dot quality can be easily obtained. In some cases, a combination of dihydroxybenzenes and 1-phenyl-3-pyrazolidones or a combination of dihydroxybenzenes and p-aminophenols may be used.

Dihydroxybenzene developing agents which can be used in the present invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5-dimethylhydroquinone, and the like. Particularly preferred is hydroquinone.

Examples of the 1-phenyl-3-pyrazolidone or its derivative developing agent which can be used in the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, and 1-p-tolyl-4,4-dimethyl-3-pyrazolidone. Particularly preferred is 1-phenyl-3-pyrazolidone, 1-phenyl-4,4-dimethyl-3-pyrazolidone, or 1-phenyl-4-methyl-4-hydroxymethyl-3-pyrazolidone.

Examples of the p-aminophenol developing agent which can be used in the present invention include N-methyl-p-aminophenol, p-aminophenol, N-($\beta$-hydroxyethyl)-p-aminophenol, N-(4-hydroxyphenyl)glycine, 2-methyl-p-aminophenol, and p-benzylaminophenol. Of these compounds, N-methyl-p-aminophenol is preferred.

The amount of the developing agent used is preferably from 0.05 to 0.8 ml/liter. When dihydroxybenzenes are used in combination with 1-phenyl-3-pyrazolidones or p-aminophenols, it is preferred that the dihydroxybenzenes be used in an amount of preferably from 0.05 to 0.6 mol/liter (developer) and particularly from 0.2 to 0.5 mol/liter (developer), and the 1-phenyl-3-pyrazolidones or p-aminophenols be used in an amount of not more than 0.06 mol/liter (developer) and particularly from 0.001 to 0.03 mol/liter (developer).

Examples of the sulfurous acid salt which is used as a preservative in the present invention include sodium sulfite, potassium sulfite, lithium sulfite, ammonium sulfite, sodium hydrogensulfite, potassium metahydrogensulfite, and sodium formaldehyde hydrogen-sulfite. The amount of the sulfurous acid salt used is preferably not less than 0.4 mol/liter (developer), particularly preferably not less than 0.5 mol/liter (developer). The upper limit is preferably up to 2.5 mol/liter (developer).

An alkali agent which is used to adjust the pH includes pH adjustors and buffers such as sodium hydroxide, potassium hydroxide, sodium carbonate, potassium carbonate, sodium triphosphate, and potassium triphosphate.

Additives other than the above-described ones which may be contained include development inhibitors such as boric acid, borax, sodium bromide, potassium bromide, and potassium iodide; organid solvents such as ethylene glycol, diethylene glycol, triethylene glycol, dimethylforamide, methyl cellosolve, hexylene glycol, ethanol, and methanol; and antifoggants or black pepper inhibitors such as mercapto compounds, e.g., 1-phenyl-5-mercaptotetrazole and sodium 2-mercaptobenzimidazole-5-sulfonate, indazole compounds, e.g., 5-nitroindazole, and benzotriazole compounds, e.g., 5-methylbenzotriazole. In addition, if desired, a color adjustor, a surfactant, a defoaming agent, a hard water-softening agent, a hardener, amino compounds as described in U.S. Pat. No. 4,269,929, and so forth may be added.

In the light-sensitive material of the present invention, an emulsion comprising a core of silver halide containing silver iodide and a shell covering the core, said shell comprising silver bromide, silver chloride, or silver chlorobromide and having a thickness of from 0.01 to 0.08 μm, is used in combination with at least one of the hydrazine derivatives represented by formula (I), so that there can be obtained characteristics of high sensitivity, high contrast, and decreased black spots, which characteristics are especially useful for the reproduction of dot images or line images.

The present invention is described below in greater detail by reference to the following examples.

In the example, a developer having the following formulation was used.

| Basic Formulation of Developer | |
|---|---|
| Hydroquinone | 35.0 g |
| N—methyl-p-aminophenol ½ sulfate | 0.8 g |
| Sodium hydroxide | 9.0 g |
| Potassium triphosphate | 74.0 g |
| Potassium sulfite | 90.0 g |
| Disodium ethylenediaminetetraacetate | 1.0 g |
| 3-Diethylamino-1-propanol | 15.0 g |
| 5-Methylbenzotriazole | 0.5 g |
| Sodium bromide | 3.0 g |
| Water to make | 1 liter |

(pH = 11.60)

EXAMPLE 1

The following emulsions I to V were prepared.

EMULSION I

An aqueous silver nitrate solution and an aqueous solution of potassium iodide and potassium bromide containing potassium iridium (III) hexachloride of $4\times10^{-7}$ mol per mol of Ag were added at the same time to an aqueous gelatin solution maintained at 50° C. in the presence of ammonia over 60 minutes. During this period, pAg was maintained at 7.8 to prepare a silver iodobromide core having an average grain size of 0.26 μm. After neutralization with acetic acid, pAg was maintained at 7.8, and an aqeuous silver nitrate solution and an aqueous potassium bromide solution containing potassium iridium (III) hexachloride of $4\times10^{-7}$ mol per mol of Ag were added at the same time to form a shell having a thickness of 0.02 μm. This emulsion was washed with water by the usual method to remove soluble salts. Then gelatin was added, and chemical sensitization using sodium thiosulfate was applied to obtain Emulsion I.

EMULSION II

In the same manner as in the preparation of Emulsion I, a silver bromide shell having a thickness of 0.05 μm was provided to a silver iodobromide core having an average grain size of 0.2 μm and chemical sensitization was applied to obtain Emulsion II.

EMULSION III

In the same manner as in the preparation of Emulsion I, a silver bromide shell having a thickness of 0.10 μm was provided to a sivler iodobromide core having an average grain size of 0.10 μm and chemical sensitization was applied to obtain Emulsion III.

EMULSION IV

In the same manner as in the preparation of Emulsion I, Emulsion III in which has the shell thickness of 0.005 μm was obtained.

EMULSION V

An aqueous silver nitrate solution and an aqueous potassium iodide and potassium bromide solution containing potassium iridium (III) hexachloride of $4\times10^{-7}$ mol per mol of Ag were added at the same time to an aqueous gelatin solution maintained at 50° C. in the presence of ammonia over 60 minutes. During this period, pAg was maintained at 7.8 to prepare a sivler iodobromide having an average grain size of 0.3 μm. This emulsion was washed with water by the usual method to remove soluble salts. Then gelatin was added, and chemical sensitization using sodium thiosulfate was applied to obtain Emulsion V.

EMULSION VI

A silver bromide emulsion having an average grain size of 0.3 μm was prepared in the same manner as in the preparation of Emulsion V. Chemical sensitization was applied in the same manner as in the preparation of Emulsion V to obtain Emulsion VI.

The extent of chemical sensitization of Emulsions I through VI was controlled so as to obtain the optimum performance. This controlling method is well known to one skilled in the art. The features of Emulsions I through VI are shown in Table 1.

The shell thickness was measured as follows.

The silver halide surface was gradually dissolved with a suitable concentration of sodium thiosulfate, and the silver halide surface was eluted until the iodide of the core be detected. The silver ion concentration eluted was calculated as a volume.

The measured values were in good agreement with the values determined by the formulation of emulsion.

TABLE 1

| Emulsion | Crystal Habit | Halogen Composition | Particle Size (μm) | Total I Content (mol %) | Shell Thickness (μm) |
|---|---|---|---|---|---|
| I | Cubic | AgBr I | 0.3 | 2.0 | 0.02 |
| II | " | " | " | " | 0.05 |
| III | " | " | " | " | 0.10 |
| IV | " | " | " | " | 0.005 |
| V | " | " | " | " | — |
| VI | " | AgBr | " | — | — |

To the above Emulsions I through VI, as sensitizing agents, a 5,5'-dichloro-9-ethyl-3-3'-bis(3-sulfopropyl-)oxacarbocyanin sodium salt, 4-hydroxyl-6-methyl-1,3,3a,7-tetraazaindene, a dispersion of polyethyl acrylate, 1,3-vinyl-sulfonyl-2-propanol and Compound I-9 were added. Each mixture was coated on a polyethyleneterephthalate film in a silver amount of 3.4 g/m$^2$. Each sample was exposed and developed, and measured for photographic characteristics. The results are shown in Table 2. As can be seen from Table 2, in Samples 1 through 4 of the present invention, the improvement in the combination of properties of sensitivity, gamma, and black spots is significantly better when compared with the Comparative Samples.

TABLE 2

| Sample No. | Emulsion | Compound I-9 Amount (mol/mol Ag) | Photographic Performance Sensitivity | gamma | Black Spots |
|---|---|---|---|---|---|
| 1 | I | $3 \times 10^{-3}$ | 100 | 16 | 4.5 |
| 2 | " | $3.3 \times 10^{-3}$ | 107 | 18 | 4.0 |
| 3 | II | $3 \times 10^{-3}$ | 98 | 16 | 5.0 |
| 4 | " | $3.6 \times 10^{-3}$ | 107 | 17 | 4.0 |
| 5* | III | $3 \times 10^{-3}$ | 95 | 8.5 | 5.0 |
| 6* | " | $3.6 \times 10^{-3}$ | 102 | 11.5 | 4.0 |
| 7* | IV | $3 \times 10^{-3}$ | 102 | 16.5 | 3.0 |
| 8* | " | $3.3 \times 10^{-3}$ | 107 | 18 | 2.0 |
| 9* | V | $3 \times 10^{-3}$ | 102 | 17.5 | 3.0 |
| 10* | " | $3.3 \times 10^{-3}$ | 110 | 19 | 1.0 |
| 11* | VI | $3 \times 10^{-3}$ | 89 | 9 | 5.0 |
| 12* | " | $3.6 \times 10^{-3}$ | 98 | 12 | 3.0 |

(Note)
*Comparative example

The relative sensitivity is a relative value of the reciprocal of an exposure amount to provide a density of 1.5 by development at 38° C. for 30 seconds, and is indicated as a relative value with that of Sample 1 as 100.

The black spots were examined with a microscope and evaluated by five-grade evaluation: the value of 5 is best and the value of 1 is worst, with "5" and "4" being practically usable, "3" being poor but practically still usable, and "2" and "1" being substantially unusable. An intermediate between "4" and "5" is "4.5".

The evaluation of black spots is the result of development at 38° C. for 40 minutes.

EXAMPLE 2

The following emulsions A to D were prepared.

EMULSION A

An aqueous silver nitrate solution and an aqueous solution of potassium iodide and potassium bromide containing potassium iridium (III) hexachloride of $4 \times 10^{-7}$ mol per mol of Ag were added at the same time to an aqueous gelatin solution maintained at 50° C. in the presence of 1,8-dihydroxyl-3,6-dithiaoctane as a silver halide solvent over 40 minutes. During this period, pAg was maintained at 7.8 to prepare a silver iodobromide core having an average grain size of 0.26 μm. Subsequently, an aqueous solution of hydrogen peroxide was added, and after being subjected to ripening for 15 minutes, an aqueous silver nitrate solution and an aqueous potassium bromide solution containing potassium iridium (III) hexachloride of $4 \times 10^{-7}$ mol per mol of Ag were added at the same time to form a shell having a thickness of 0.02 μm. This emulsion was washed with water by the usual method to remove soluble salts. Then gelatin was added, and a surface conversion was applied by adding an aqueous potassium iodide solution having an iodide content of 0.1 mol % per mol of Ag to obtain Emulsion A.

EMULSION B

The same manner as in the preparation of Emulsion A was repeated to obtain Emulsion B except that the surface conversion due to the aqueous potassium iodide solution was not applied.

EMULSION C

An aqueous silver nitrate solution and an aqueous solution of potassium iodide and potassium bromide containing potassium iridium (III) hexachloride of $4 \times 10^{-7}$ mol per mol of Ag were added at the same time to an aqueous gelatin solution maintained at 50° C. in the presence of 1,8-dihydroxy-3,6-dithiaoctane as a silver halide solvent over 40 minutes. During this period, pAg was maintained at 7.8 to prepare a silver iodobromide having an average grain size of 0.3 μm. Subsequently, an aqueous solution of hydrogen peroxide was added, and after being subjected to ripening for 15 minutes, this emulsion was washed with water by the usual method to remove soluble salts. Then gelatin was added to obtain Emulsion C.

EMULSION D

A silver bromide emulsion (Emulsion D) having an average grain size of 0.3 μm was prepared in the same manner as in the preparation of Emulsion C.

The features of Emulsions A through D are shown in Table 3.

TABLE 3

| Emulsion | Crystal Habit | Halogen Composition | Particle Size (μm) | Total I Content (mol %) | Shell Thickness (μm) |
|---|---|---|---|---|---|
| A | cubic | AgBr I | 0.3 | 2.6 | 0.02 |
| B | " | " | " | 2.5 | 0.02 |
| C | " | " | " | 2.5 | — |
| D | " | AgBr | " | — | — |

To the above Emulsions A through D, the same additives as compounds used in Example 1 were added. Each mixture was coated on a polyethyleneterephthalate film in a silver amount of 3.5 g/m$^2$. Each sample was exposed and developed, and measured for photographic characteristics. The results are shown in Table 4. As can be seen from Table 4, in Samples 13 through 16 of the present invention, the improvement in the combination of properties of sensitivity, gamma, and black spots is significantly better when compared with the Comparative Samples.

The photographic performance and the black spots were examined by the same method as in Example 1.

TABLE 4

| Sample No. | Emulsion | Compound I-9 Amount (mol/mol Ag) | Photographic Performance Sensitivity | gamma | Black Spots |
|---|---|---|---|---|---|
| 13 | A | $4 \times 10^{-3}$ | 100 | 15.5 | 4.5 |
| 14 | " | $5 \times 10^{-3}$ | 110 | 16.5 | 4.0 |
| 15 | B | $4 \times 10^{-3}$ | 95 | 15.0 | 4.5 |
| 16 | " | $5 \times 10^{-3}$ | 102 | 16.0 | 4.0 |
| 17* | C | $3.6 \times 10^{-3}$ | 100 | 16.0 | 3.0 |
| 18* | " | $4.6 \times 10^{-3}$ | 110 | 16.5 | 2.0 |
| 19* | D | $4.6 \times 10^{-3}$ | 92 | 10.0 | 5.0 |
| 20* | " | $5.6 \times 10^{-3}$ | 98 | 12.5 | 3.0 |

(Note)
*Comparative example

Accordingly, as can be seen from Tables 2 and 4 of Examples 1 and 2, the present invention has a superiority with respect to the improvement in the combination of properties of sensitivity, gamma, and black spots.

While the invention has been described in detail and with reference to specific embodiments thereof, it will be apparent to one skilled in the art that various changes and modifications can be made therein without departing from the spirit and scope thereof.

What is claimed is:

1. A negative type silver halide photographic material comprising a support and at least one silver halide emulsion layer on the support, wherein said emulsion layer comprises silver halide grains comprising a core of silver halide containing silver iodide and a shell covering the core, said shell consisting essentially of silver bromide, silver chloride, or silver chlorobromide and having a thickness of from 0.01 to 0.08 μm, and the emulsion layer or a hydrophilic colloid layer other than the emulsion layer of said photographic material contains a hydrazine derivative.

2. A negative type silver halide photographic material as in claim 1, wherein said shell consists of silver bromide.

3. A negative type silver halide photographic material as in claim 1, wherein said shell has a thickness of from 0.02 to 0.06 μm.

4. A negative type silver halide photographic material as in claim 2, wherein said shell has a thickness of from 0.02 to 0.06 μm.

5. A negative type silver halide photographic material as in claim 1, wherein the silver iodide content of the core is from 1.0 to 8 mol %.

6. A negative type silver halide photographic material as in claim 1, wherein the silver iodide content of the core is from 1.5 to 4.0 mol %.

7. A negative type silver halide photographic material as in claim 6, wherein the iodide is distributed uniformly in the core.

8. A method for forming a super high contrast negative image which comprises imagewise exposing a silver halide photographic material comprising a support and at least one silver halide emulsion layer on the support, wherein said emulsion layer comprises silver halide grains comprising a core of silver halide containing silver iodide, and a shell covering the core, said shell consisting essentially of silver bromide, silver chloride, or silver chlorobromide and having a thickness of from 0.01 to 0.08 μm, and the emulsion layer or a hydrophilic colloid layer other than the emulsion layer of said photographic material contains a hydrazine derivative, and then developing the photographic material with a developer containing at least 0.15 mol/liter of sulfite ion and having a pH of from 10.5 to 12.3.

9. A method for forming a super high contrast negative image as in claim 8, wherein said shell consists of silver bromide.

10. A method for forming a super high contrast negative image as in claim 8, wherein said shell has a thickness of from 0.02 to 0.06 μm.

11. A method for forming a super high contrast negative image as in claim 9, wherein said shell has a thickness of from 0.02 to 0.06 μm.

12. A method for forming a super high contrast negative image as in claim 8, wherein the silver iodide content of the core is from 1.0 to 8 mol %.

13. A method for forming a super high contrast negative image as in claim 8, wherein the silver iodide content of the core is from 1.5 to 4.0 mol %.

14. A method for forming a super high contrast negative image as in claim 13, wherein the iodide is distributed uniformly in the core.

* * * * *